United States Patent [19]

Haslam

[11] 4,146,941

[45] Apr. 3, 1979

[54] BOAT BOW LADDER ASSEMBLY

[75] Inventor: Ivan S. Haslam, Bountiful, Utah

[73] Assignee: Shirley B. Haslam, Bountiful, Utah

[21] Appl. No.: 841,276

[22] Filed: Oct. 12, 1977

[51] Int. Cl.[2] ..... B63B 17/00

[52] U.S. Cl. ..... 9/1.6; 182/91; 182/92; 182/97

[58] Field of Search ..... 9/1.6, 1.1; 114/221 R; 182/99, 124, 165, 166, 171, 91, 92, 97

[56] References Cited

U.S. PATENT DOCUMENTS

| | | | |
|---|---|---|---|
| 2,669,733 | 2/1954 | Picker | 9/1.6 |
| 3,052,869 | 9/1962 | Beach | 9/1.6 |

*Primary Examiner*—Trygve M. Blix

*Assistant Examiner*—Jesus D. Sotelo

*Attorney, Agent, or Firm*—Lynn G. Foster

[57] ABSTRACT

A boat bow ladder comprising a mounting bracket facilely cradled to the bow of a boat preferably by means of an existing eye used to connect the bow of the boat to a trailer when transporting the boat by land. The mounting bracket accommodates manual placement and removal of the angular ladder portions of the ladder, the ladder portion comprising a bracket engaging main leg pivotally mounted adjacent one end thereof to one end of a second main leg having a plurality of rungs, the pivotal connection accommodating placement of the ladder portion in either a stored position or a use position whereby access to and from the boat is conveniently provided at the bow.

8 Claims, 5 Drawing Figures

FIG. 1
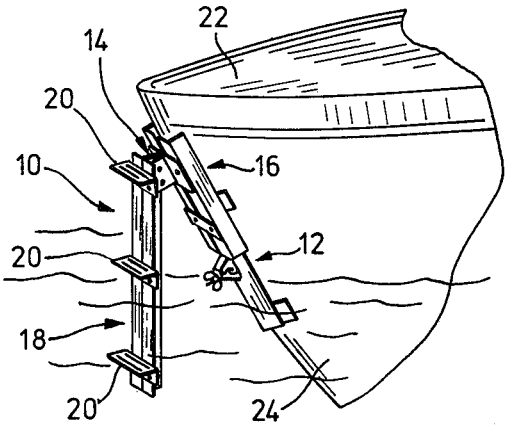
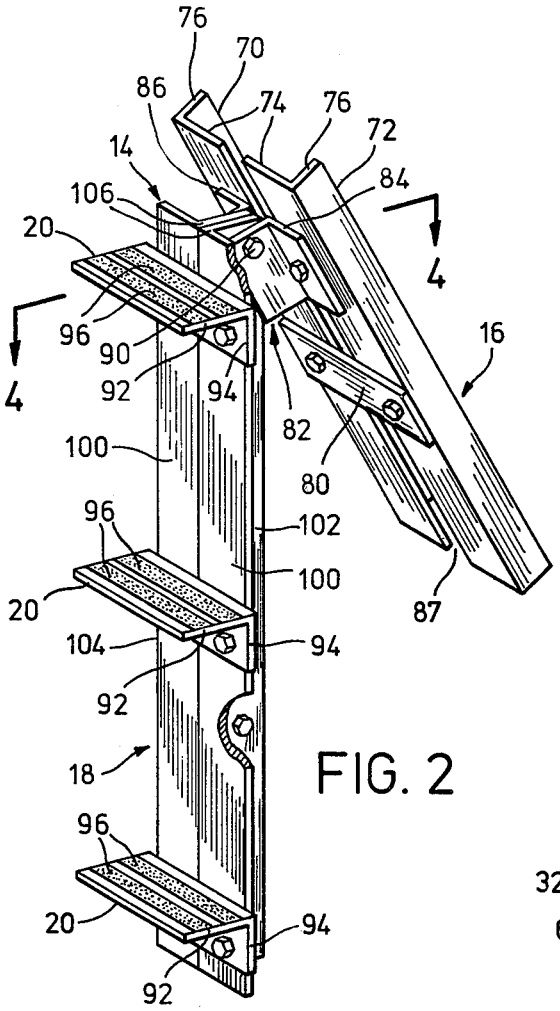
FIG. 2
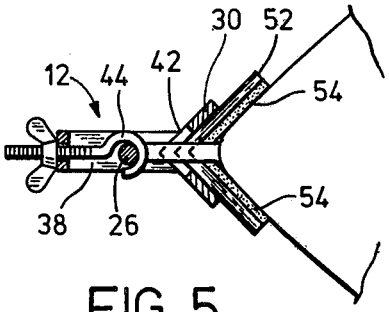
FIG. 5
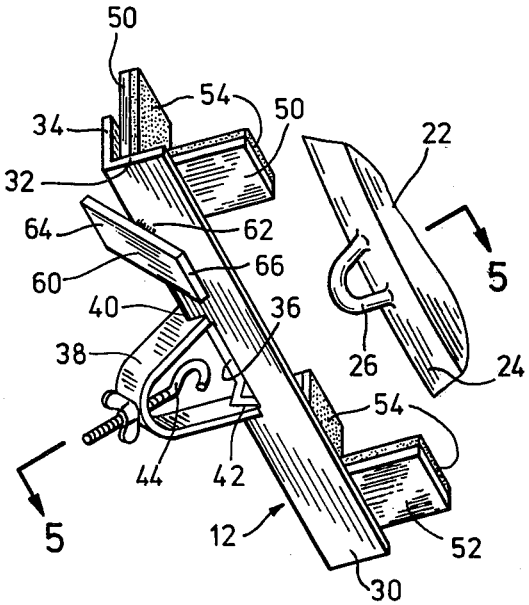
FIG. 3
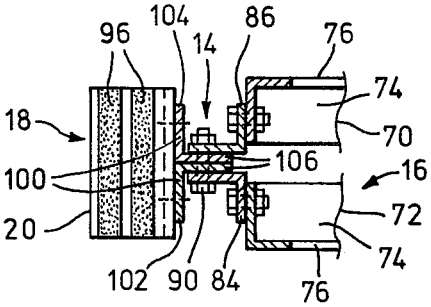
FIG. 4

BOAT BOW LADDER ASSEMBLY

BACKGROUND

1. Field of Invention

The present invention relates generally to ladders for boats and more particularly to a novel boat bow ladder assembly whereby ready access to the boat via the bow is provided achieving without obstruction a far greater element of convenience than stern boat ladders per se.

2. Prior Art

Prior art proposals respecting provision of access ladders adjacent the bow of a boat have consisted of relatively complex and expensive devices and/or have relied upon ropes or chains as rungs which lack stability. Such proposals have also required that the deck and other areas otherwise usable to the occupants of the boat be obstructed and encumbered. Typical of said prior art proposals are the contents of U.S. Pat. Nos. 2,669,733 and 3,052,896.

BRIEF SUMMARY AND OBJECTS OF THE INVENTION

The present invention comprises a boat bow ladder assembly including a mounting bracket carried at the bow of the boat at an elevation below the deck line and disposed at an angle to the horizontal and the vertical. Preferably the mounting bracket is secured to the boat eye at the bow (the one used to secure the boat to a trailer when being transported over land). The ladder is manually secured to and removed from the mounting bracket adjacent one main leg of the ladder, the other main leg comprising a plurality of exposed rungs. Preferably, the two main legs are pivotally secured one to the other to accommodate placement of the main leg comprising the rungs in either a generally vertical "use" position or a folded "stow" position. The result is a ladder which does not obstruct the usable areas of the boat, which is generally concealed, durable, stable and useful to accommodate ingress and egress at the bow whereby, for example, upon beaching, said access may be via dry land as opposed to human entry into the water where a conventional stern ladder is used.

With the foregoing in mind, it is a primary object of the present invention to provide a novel boat bow ladder mechanism.

It is a further important object of the present invention to provide a bow ladder assembly comprising support structure snugly mounted to the bow of the boat and ladder structure carried by the support structure.

It is a further paramount object of the present invention to provide a novel boat bow ladder assembly comprising a mounting bracket facilely secured to the bow of a boat without obstructing, use areas of the boat, and a ladder mechanism having a portion contiguously secured to the mounting bracket and a portion comprising exposed rungs.

It is a further principal object of the present invention to provide a novel boat bow ladder assembly wherein a ladder portion comprises pivotal parts whereby a part of the ladder comprising exposed rungs may be placed in either a use position or a stow position.

It is a further important object of the present invention to provide a novel boat bow ladder assembly which requires no special tools, if any, to install, does not damage or alter the boat, utilizes existing boat fastening structure and does not encumber or obstruct usable area of the boat accommodating the direct access to land when the boat is beached without human entry into the water.

A further valuable object of the present invention is the provision of a novel boat bow ladder assembly comprising a support portion mounted to the bow of the boat and a manually removable ladder portion.

These and other objects and features of the present invention will be apparent from the detailed description taken with reference to the accompanying drawings.

BRIEF DESCRIPTION OF THE DRAWINGS

FIG. 1 is a perspective representation of a presently preferred boat bow ladder assembly according to the present invention, illustrated as mounted to the bow of a boat;

FIG. 2 is an enlarged perspective representation, with portions broken away for purposes of clarity, of the ladder portion of the boat bow ladder assembly of FIG. 1;

FIG. 3 is an enlarged perspective representation of the mounting bracket portion of the boat bow ladder assembly of FIG. 1;

FIG. 4 is a plan view, shown partially in cross-section taken along line 4—4, of FIG. 2; and FIG. 5 is a cross-section taken along line 5—5 of FIG. 3.

DETAILED DESCRIPTION OF THE ILLUSTRATED EMBODIMENT

Particular reference is now made to the drawings wherein like numerals are used to designate like parts throughout and which illustrate the presently preferred embodiment of the present invention. The embodiment, generally designated 10, comprises a boat bow ladder assembly which includes a mounting or support bracket 12 and a ladder portion 14. The ladder portion 14 comprises a first main leg portion 16, adapted to be manually slideably coupled to the mounting or support bracket 12, and a second main leg portion 18, presenting a plurality of exposed rungs 20. The boat bow ladder assembly 10 is illustrated in FIG. 1 in its mounted position upon the bow 24 of a boat 22 with the main rung leg 18 disposed in essentially a vertical "use" position.

As best illustrated in FIGS. 3 and 5, the leading edge of the bow 24 of the boat 22 comprises an eye 26. The eye 26 is conventional and is used to secure the boat 22 to its trailer during transportation on land. Preferably the present invention utilizes the eye 26 as convenient structure for facilely securing the mounting bracket 12 to the bow of the boat out of the way well below the deck line so that a boat bow ladder assembly according to the present invention will not encumber or obstruct the deck or other usable areas of the boat 22.

The mounting bracket 12 essentially cradles the leading edge of the bow 24 and comprises a main body member 30 which may be an angle in cross-section, preferably formed of light weight, low corrosive aluminum. The included angle between the legs 32 and 34 of the body member 30 is preferably the same or substantially the same as the angle defined by the converging exterior surfaces of the bow 24 adjacent the eye 26. See FIG. 5. There exists a central elongated slot 36 approximately midway along the axis of the body member 30 symmetrical between the legs 32 and 34. The slot 36 is sized to accommodate ready relative displacement of the eye 26 therethrough. The slot 36 is bridged top to bottom by a generally arcuate metal band 38 of aluminum or the like having an aperture at the apex thereof spaced from but in alignment with the center of the slot 36. The ends 40 and 42 of the band 38 are welded or otherwise suitably secured to the body member 30 immediately above and below the slow 36. The threaded shaft of an eye bolt 42 is loosely fitted through the central aperture of the band 38 so as to project inwardly toward the slot 36. The eye of the eye bolt 44 is caused to be hooked through the eye 26 of the bow 24. This leaves a portion of the threaded shaft of the eye bolt 44 exposed beyond the band 38 upon which a wing nut or the like with or without a lock washer etc. is firmly threaded to thereby cause the mounting bracket 12 to be firmly and rigidly secured to and cradled against the bow of the boat below the deck line and at a location where no encumbrance or obstruction is created.

The interior surfaces of two angular cradle members 50 and 52 are thus caused to firmly contiguously engage the diverging exterior bow surfaces as best shown in FIG. 5. The angular cradle members 50 and 52 comprise preferably aluminum which is welded or otherwise suitably secured in the illustrated positions at the interior surface of the body member 30 as by welding. The interior of each pad member 50 and 52 comprises preferably an elastomeric layer 54 of neoprene or the like to avoid damage to the boat. Adjacent the upper end of the body member 30 is located a cross bar 60 welded or otherwise suitably secured to the member 30 at site 62. The cross member 60 is essentially perpendicular to the axis of the bracket 12 and to a line bisecting the included angle between the legs 32 and 34 of the body member 30. Member 60 comprises cantilevered ends 64 and 66 whereby the ladder portion 14 is caused to be mounted thereto in a manner more fully hereinafter explained.

Particular reference is now made to FIGS. 2 and 4 which illustrate the ladder portion 14 in detail. The main coupling leg portion 16 in the embodiment illustrated in the Figures comprises a pair of elongated angles 70 and 72, fabricated preferably of aluminum stock. The angles 70 and 72 are shown to be identical though opposite hand. The respective longer legs 74 of angles 70 and 72 are disposed in a common plane and the short legs 76 are spaced, parallel and equal distance from the longitudinal axis of the coupling main leg 16. The space between the two angles comprises slot 87. The angles 70 and 72 are secured together in the illlustrated and described position by a metal plate 80 transversely bridging between and being respectively bolted to the legs 74 of the two angles 70 and 72. The angles 70 and 72 are also secured together by a pivotable connector 82 comprising spaced opposed lugs 84 and 86, the base leg of each lug 84 and 86 being bolted or otherwise suitably secured to the adjacent leg 74.

A pivot pin 90 spans between the parallel, spaced and outwardly projecting legs of the lugs 84 and 86. This accommodates pivotal displacement as hereinafter more completely described. In any event by the indicated coupling of the plate 80 and the lugs 84 and 86 to the elongated angles 70 and 72 of the main coupling leg 16 secure the leg 16 in the illustrated position and defines the slot 87 of uniform width throughout.

When it is desired to manually couple the ladder portion 14 to the mounting bracket 12 (when the mounting bracket 12 has been previously anchored to the bow of the boat as earlier described), the lower ends of the angles 70 and 72 are placed behind the cantilevered projection 64 and 66 of the cross piece 60 of the mounting bracket 12 immediately adjacent the body member 30. The angle members 70 and 72 are downwardly relatively displaced until the coupling leg 16 is disposed in the load transferring position illustrated in FIG. 1. The opposite procedure is followed to manually remove the ladder portion 14 from the mounting bracket 12. Obviously, no tools are required and no encumbrances or obstructions are created either during placement or removal or while the ladder portion 14 is left in its coupled load transferring position upon the mounting bracket 12.

The ladder leg 18 as previously mentioned, comprises a plurality of rungs 20. As illustrated, each rung forms a right angle in cross-section and is transverse to the axis of the main ladder leg 18. One leg 92 of each rung 20 is disposed in a horizontal plane (when the main leg 18 is essentially vertical) and projects outwardly. The other leg 94 of each rung 20 is vertically disposed, all legs 94 being in a common plane. If desired, some anti-friction abrasive strips 96 may be placed on the top surface of each rung 92.

The angle rungs 20 are vertically spaced equidistance and respectively secured by bolts or the like to base legs 100 of two elongated contiguous angles 102 and 104. These angles 102 and 104 have said base legs 100 in a common plane as illustrated with the remaining legs 106 contiguous with and bolted or otherwise secured in that position.

The legs 106 of the angles 102 and 104 snugly fit between the lugs 84 and 86. The pivot pin 90 passes loosely through said legs 106 as well as the outwardly projecting legs of the lugs 84 and 86 to accommodate pivotal displacement of leg 18 in respect to leg 16. The length of main leg 18 may vary depending upon the desires of the user and the size of the boat upon which the ladder assembly 10 or the like is to be mounted. In any event, the bottom rung 20 should be in the water (or near the ground when the boat 22 is beached) and the top rung near the deck of the boat.

As mentioned previously, when the main leg 16 is mounted essentially parallel to the leading bow edge of the boat at 24 (and the main legs 16 and 18 form an included acute angle) and leg 18 is essentially vertical, the ladder is in the "use" position.

To stow the ladder, it is either manually lifted from the mounting bracket 12 and stored in the boat 22, or the main leg 18 is pivoted so as to become parallel or substantially parallel to the main leg 16 and the pivot bolt 90 thereafter tightened sufficient to retain said "stowed" position.

It is to be appreciated by the foregoing that the present invention accommodates facile mounting to an existing boat without requiring structural alteration and without creating obstruction or any encumbrance to the use of the boat. The mounting location is below the deck line on the bow accommodating ready ingress and egress from land when the boat is beached without the requirement of getting into the water. The arrangement is durable, and stable. It is relatively inexpensive and not subject to damage or repair requirements of any substantial nature. It may be placed, used and removed with few if any tools or special equipment.

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A boat bow ladder mechanism comprising:

support means comprising means to be fixedly secured to the outside of the bow of a boat below the deck line thereof and above the water line and disposed angularly with respect to the horizontal and vertical;

ladder means comprising means physically connected to the support means exterior of the bow below the deck line for transfer of load thereto and rung carrying means disposed, at least during use, in a substantially vertical orientation.

2. A mechanism as defined in claim 1 wherein the rungs of said rung carrying means comprise spaced substantially horizontal steps rigidly supported in said use position by the remainder of said rung carrying means.

3. A boat bow ladder mechanism comprising:

support means to be mounted to the bow of a boat below the deck line thereof and disposed angularly with respect to the horizontal and vertical;

ladder means comprising means connected to the support means for transfer of load thereto and rung carrying means disposed, at least during use, in a substantially vertical orientation, the ladder means comprise two main elongated leg means, one main elongated leg means comprising said connected means and the other elongated main leg means comprising said rung carrying means, and further comprising means joining the upper ends of said two main elongated leg means one to the other whereby during use the other main elongated leg means depend from and form an included acute angle with the other main elongated leg means.

4. A mechanism as defined in claim 3 wherein the joining means comprises means pivotally connecting said main elongated leg means together accommodating relative pivotal displacement between said angular use position and a stow position where said main elongated leg means are substantially parallel.

5. A mechanism as defined in claim 1 wherein the one main elongated leg means comprises means slideably engaged with and releasably retained by the support means at least in part by force of gravity.

6. A boat bow ladder mechanism comprising:

support means to be mounted to the bow of a boat below the deck line thereof and disposed angularly with respect to the horizontal and vertical;

ladder means comprising means connected to the support means for transfer of load thereto and rung carrying means disposed, at least during use, in a substantially vertical orientation;

said support means comprise (a) angular cradle means to engage the leading bow edge and the adjacent opposed diverging bow side surfaces of the boat to distribute ladder load to the boat; (b) fastening means to attach to an existing boat bow eye to thereby firmly secure the support means to the bow without structural alteration to the boat; and (c) means to which the ladder means releasably attach.

7. A mechanism according to claim 6 wherein the last mentioned means comprise means slideably receiving and releasably retaining said ladder means, at least in part by force of gravity.

8. A boat bow ladder mechanism comprising support means and ladder means;

said support means comprising fastener means releasably connectable to a trailer eye at the leading edge of the bow of a boat, means by which the load of the ladder mechanism is directly transferred to said bow and coupling means to slideably receive and releasably retain said ladder means;

said ladder means comprising first elongated leg means having means adjacent the lower end thereof to slideably and releasably engage said coupling means and pivotable connector means adjacent the higher end thereof, said ladder means further comprising a second elongated leg means having pivotable connector means adjacent the higher end thereof, which pivotally join the pivotable connector means of the first elongated leg means, and exteriorly accessible rung means disposed at spaced locations along the length of the second elongated leg means;

said joined pivotable connectors accommodating relative substantially manual displacement between an inverted V-shaped use position, wherein the first elongated leg means is contiguous with the bow of the boat below the deck at an angle to the horizontal and the vertical, and the second elongated leg means is substantially vertical, and a stow position, wherein both elongated leg means are substantially parallel to each other and to the adjacent bow.

* * * * *